United States Patent [19]

Hock et al.

[11] Patent Number: 4,924,633

[45] Date of Patent: May 15, 1990

[54] APPARATUS FOR USE WITH STATIONARY BELT SANDER STATION

[75] Inventors: Thomas H. Hock; Michael L. O'Banion, both of Westminister, Md.; Heinrich P. F. Koehler, Hanover, Pa.; Joseph Wynes, Baltimore, Md.

[73] Assignee: Black & Decker Inc., Newark, Del.

[21] Appl. No.: 232,301

[22] Filed: Aug. 12, 1988

[51] Int. Cl.[5] ..... B24B 21/18

[52] U.S. Cl. ..... 51/135 R; 51/128; 51/141; 144/253 R; 83/468.7

[58] Field of Search ..... 51/102, 128, 135 R, 51/137, 141, 170 EB, 241.6; 83/467 R, 467 A; 144/253 R, 253.6

[56] References Cited

U.S. PATENT DOCUMENTS

| | | | |
|---|---|---|---|
| 947,491 | 1/1910 | Bein | 51/141 |
| 1,036,783 | 8/1912 | Bein . | |
| 1,228,520 | 6/1917 | Behringer . | |
| 1,820,377 | 8/1931 | Curtis | 51/141 |
| 2,055,351 | 9/1936 | Hormel . | |
| 2,232,149 | 2/1941 | Tautz . | |
| 2,252,160 | 8/1941 | Blood . | |
| 2,252,455 | 8/1941 | Bishel . | |
| 2,259,883 | 10/1941 | Gleba . | |
| 2,325,083 | 7/1943 | Tautz . | |
| 2,416,493 | 2/1947 | Newton . | |
| 2,599,170 | 6/1952 | Franks . | |
| 2,776,744 | 1/1957 | Cook . | |
| 2,832,179 | 4/1958 | Beltram et al. . | |
| 2,833,419 | 5/1958 | Trumpy . | |
| 2,855,107 | 10/1958 | Roth . | |
| 2,857,717 | 10/1958 | Edgemond, Jr. et al. . | |
| 3,180,063 | 4/1965 | Burrows et al. . | |
| 3,341,976 | 9/1967 | Pace . | |
| 3,646,712 | 3/1972 | Quintana . | |
| 3,668,809 | 6/1972 | Coon . | |
| 3,824,745 | 7/1974 | Hutchins . | |
| 3,941,002 | 3/1976 | Tucker, Jr. . | |
| 4,186,784 | 2/1980 | Stone . | |
| 4,204,371 | 5/1980 | Horwitz | 51/141 |
| 4,231,193 | 11/1980 | Siegel . | |
| 4,259,887 | 4/1981 | Dean | 144/253 R X |
| 4,372,401 | 2/1983 | Fischer . | |
| 4,561,624 | 12/1985 | Freeman . | |
| 4,621,462 | 11/1986 | Hinshaw . | |
| 4,721,023 | 1/1988 | Bartlett et al. . | |

FOREIGN PATENT DOCUMENTS

| | | |
|---|---|---|
| 1096793 | 1/1961 | Fed. Rep. of Germany . |
| 611739 | 10/1960 | Italy . |
| 819328 | 9/1959 | United Kingdom . |

OTHER PUBLICATIONS

Delta Industrial Machinery, Delta International Machinery Corp., 246 Alpha Drive, Pittsburgh, PA, 15238, 11/1984.

*Primary Examiner*—Robert P. Olszewski

*Attorney, Agent, or Firm*—Harness, Dickey & Pierce

[57] ABSTRACT

A manually adjustable combined edge and end fence for a belt sander comprises a first sanding fence member coupled to a second sanding fence member extending transversely, and preferably orthogonally, to the first fence member. The second fence member also functions as an adjustable slotted table mount to the belt sander. The first fence member can function either as an end stop or a side fence by being rotated 90 degrees in a plane parallel to the sanding surface of the belt sander. The slotted mounting arrangement enables continuous adjustment of the assembly along the axis of movement of the sanding belt, including adjustment to locations of the first member beyond the end of the belt for accommodating work pieces of long length. The invention additionally contemplates a wrench retainer accessory, use of single sized adjusting bolt heads, a support table and motor mount arrangement providing improved rigidity, and an improved dust removal arrangment.

2 Claims, 6 Drawing Sheets

APPARATUS FOR USE WITH STATIONARY BELT SANDER STATION

BACKGROUND OF THE INVENTION

The invention relates generally to accessories and arrangements for stationary belt sander work stations. More particularly, the invention concerns an adjustable fence for supporting work pieces being sanded by such stations, a support stand of increased rigidity for belt sanders, and two improvements in the dust removal vacuum systems of such belt sanding stations.

Stationary belt sanders have traditionally used a variety of work supporting surfaces commonly known as "fences". Fences may be used as "end" fences where an end of the work piece is abutted against the fence which is extending generally transversely to the direction of sanding belt travel. Additionally, such fences may be used as "edge" fences wherein a side surface of the work piece is supported against the fence which is extending substantially parallel to the axis of belt travel.

None of the art known to applicant teaches continuous adjustment of an end fence along the axis of motion of the sanding belt. Additionally, no known belt sanding stations offer uniformity of adjusting mechanisms, such as wrench-adjustable bolts of a single size, increased rigidity of the sander support table, and easy storage of adjusting wrenches as contemplated by the instant invention. Also, none of the known art is believed to teach improved vacuum dust removal in a belt sanding station in accordance with the principles of the instant invention, nor are there known teachings of support tables having a unitary motor mount, cross member and tool mounting surface. Finally, no known art is believed to teach an arrangement for retaining adjusting wrenches as contemplated by the instant invention.

SUMMARY OF THE INVENTION

An improved adjustable combined edge and end fence assembly is provided for a stationary belt sanding work station having an endless sanding belt engaging spaced apart rollers mounted to a belt support bed. The adjustable fence assembly includes a first sanding fence member and a second sanding fence member coupled to and extending transversely of the first member, the second member including apparatus for effecting continuous adjustment of a position of the second member with respect to the belt support bed in a direction parallel to an axis of movement of the sanding belt.

The invention additionally contemplates an improvement in a stationary belt sanding work station having a plurality of relatively moveable adjustable portions coupled to one another by a plurality of adjusting bolts wherein the improvement comprises a provision of adjusting bolt heads all having a single size wrench receiving socket, thereby avoiding necessity for more than one size of adjusting wrench for use with the entire sanding system.

Still further, the invention contemplates apparatus coupled to a preselected portion of the support table of a stationary belt sanding work station, the apparatus adapted for retaining a shank of at least one adjusting wrench. The retaining apparatus includes a clip of spring-like resilient material including at least one channel therein having first and second spring biased walls for retentive receipt of the adjusting wrench shank, the bottom surface of the at least one channel having formed therein at least one raised dimple member for engaging the shaft, the clip further including at least one mounting hole for receipt of a suitable fastener for coupling the clip to the sander support table.

Additionally, the invention contemplates an improved arrangement for providing rigidity to a table stand having a plurality of support legs for a stationary belt sander. The improved arrangement includes a unitary motor mount and stand cross-frame member having a top portion for mounting an end of a belt sander housing and a motor mounting portion extending downwardly from the top portion between two of the support legs, the motor mounting portion including mounting slots for a motor to be positioned under the top portion and between the two legs, and means for rigidly coupling the motor mounting portion to each of the two legs, thereby enabling the motor mounting portion to act as a cross-frame support member for the table stand.

Additionally, the invention contemplates an improvement in a stationary belt sanding work station having a sanding belt driven from a drive shaft coupled to a belt roller at one end of the sanding belt loop and a dust collecting chamber substantially surrounding the belt and belt roller and coupled to a source of suction, the improvement comprising means for closing off all open areas adjacent to and in the plane of the belt surface within the collecting chamber to substantially restrict air flow toward the vacuum source to that air flowing across the abrading surface of the sanding belt.

Also, the invention contemplates an improved dust removal vacuum system in a stationary belt sanding work station having a sanding belt and a sanding disk driven from a common drive shaft coupled to a motor via a pulley and drive belt surrounded by a pulley and drive belt cover, the drive shaft extending through a clearance hole in the pulley and drive belt cover toward a belt sander drive roller. A sanding disk guard substantially surrounding the sanding disk except for a portion of the disk face adapted to engage a work piece has a source of suction coupled thereto. The improvement comprises decreasing the clearance between a periphery of the clearance hole for the drive shaft in the wall of the pulley and drive belt cover such that less air is drawn therethrough toward the vacuum source.

BRIEF DESCRIPTION OF THE DRAWING

The objects and features of the invention will become apparent from a reading of a detailed description, taken in conjunction with the drawing, in which.

DETAILED DESCRIPTION

Belt and Disk Sanding Station

Figure 1:
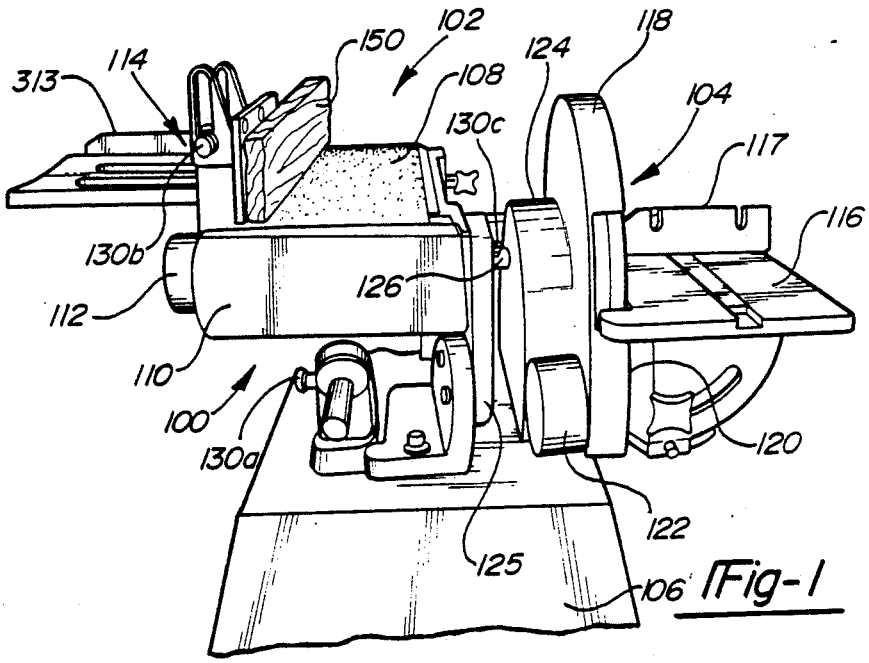
FIG. 1 is a perspective view of a belt sanding station arranged in accordance with the principles of the invention.

FIG. 1 depicts a combination belt and disk sanding station 100 arranged in accordance with the principles of the invention. The belt sander assembly 102 and disk sander assembly 104 are commonly driven by a drive shaft 126 which in turn is driven by a drive belt-pulley combination (not specifically shown), the drive belt being driven by a drive motor (also not specifically shown in FIG. 1). The drive belt-pulley combination is enclosed in a cover 124.

Drive shaft 126 rotates a sanding belt roller which is substantially surrounded by a dust collecting chamber 110 having a cylindrical connection 112 to a source of vacuum.

Guard 118 substantially surrounds the sanding disk of the station except for a portion thereof which is intended to make contact with a work piece held on side table 116 in conjunction with an adjustable fence 117 for the disk sander 104.

Guard 118 also has a cylindrical connection 122 which may be coupled to a source of vacuum. In the side table 116 of the disk sander assembly 104, guard 118 has a front face 120 suitably spaced from the abrading surface of the disk.

A typical work piece 150 is shown in FIG. 1 being operated upon by sanding belt 108 of belt sander assembly 102 and is positioned with respect to the sanding belt 108 through use of an adjustable fence assembly 114 which, in FIG. 1, is being used as a so-called edge fence.

Figure 6:
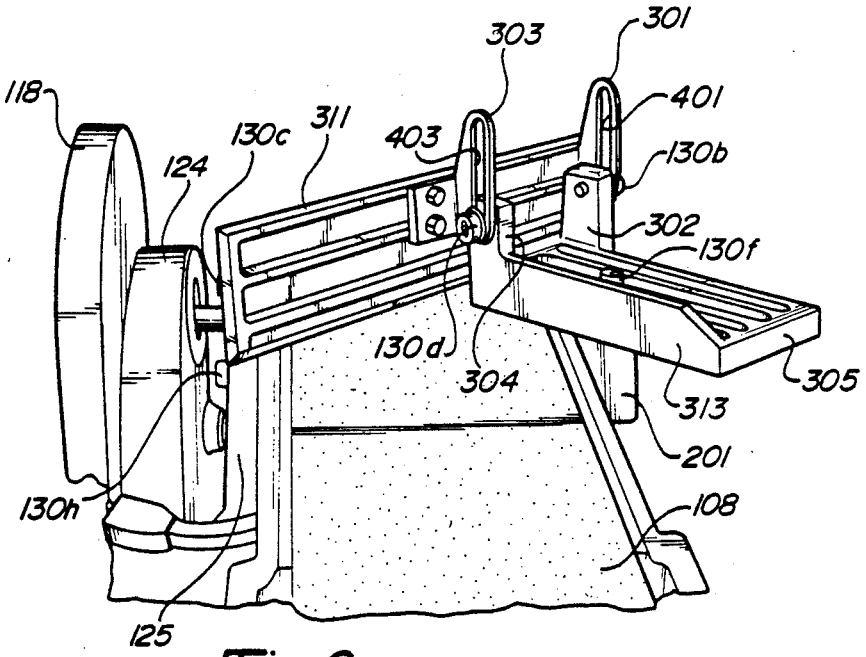
FIG. 6 is a perspective view showing the adjustable fence in an intermediate angularly rotatable position.

Both the belt sander assembly 102 and the disk sander assembly 104 are mounted to a support stand or table 106. Various components of the assemblies depicted in FIG. 1 may be adjusted relative to each other or to support table 106 by the loosening of various adjusting bolts. These bolts may be associated with the combined edge and end fence assembly 114 or with other component parts of the assemblies of FIG. 1. Typical adjusting bolts are shown in FIG. 1 at 130*a*, 130*b*, 130*c*, and in FIG. 3 at 130*d*, 130*e*, and 130*f*. An additional bolt 130*h* is also seen in the view of FIG. 6. Bolts 130*c* and 130*h* are received in tapped holes in mounting plate 125 of the belt sander assembly 102.

It should also be noted that the invention contemplates providing all adjusting bolts with the same size socket for accommodating a single size of adjusting hexagonal wrench. With reference to FIGS. 1 and 6, it will be noted that all adjusting bolts 130 are accessible with a single size adjusting hex wrench except for adjusting bolts 130*c* and 130*h*. Bolts 130*c* and 130*h*, due to their location between plate 125 and housing 124, cannot be adjusted with a conventional hex wrench. However, bolts 130*c* and 130*h* may be made the same size as the other adjusting bolts, since clearance between the pulley and drive belt cover 124 and plate 125 has been designed such that bolts 130*c* and 130*h* are accessible via any suitable style of adjustable wrench.

Adjustable Combination Edge and End Fence

The combined edge and end fence assembly 114 is best described in more detail with reference to FIGS. 1 through 7. With reference to FIGS. 1 through 4A, the edge fence assembly 114 includes a first member 311 and a second slotted adjustment member 305 extending transversely and preferably orthogonally to the first fence member.

Figure 2:
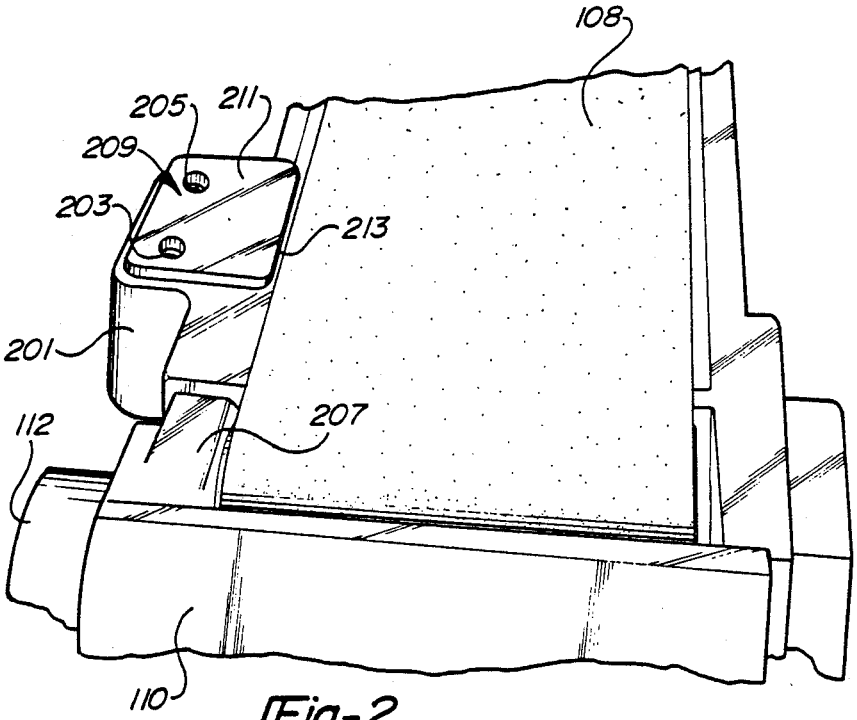
FIG. 2 is a perspective view from above the sanding belt of the station of FIG. 1 with the adjustable fence portion removed therefrom.

The adjustable fence assembly 114 is rigidly coupled to the belt sander support bed at bed mounting portion 201 (FIG. 2). Fence member 305 rests on a top surface 211 of a spacer member 209 having mounting through-holes 203 and 205 aligned with corresponding threaded holes tapped into portion 201 for receipt of threaded bolts for attaching fence member 305 to portion 201. Spacer member 209 may, for example, have a thickness on the order of one-eighth inch such that surface 211 is above the plane of the abrading surface of belt 108, while edge surface 213 intersects the plane of the abrading surface.

Figure 5:
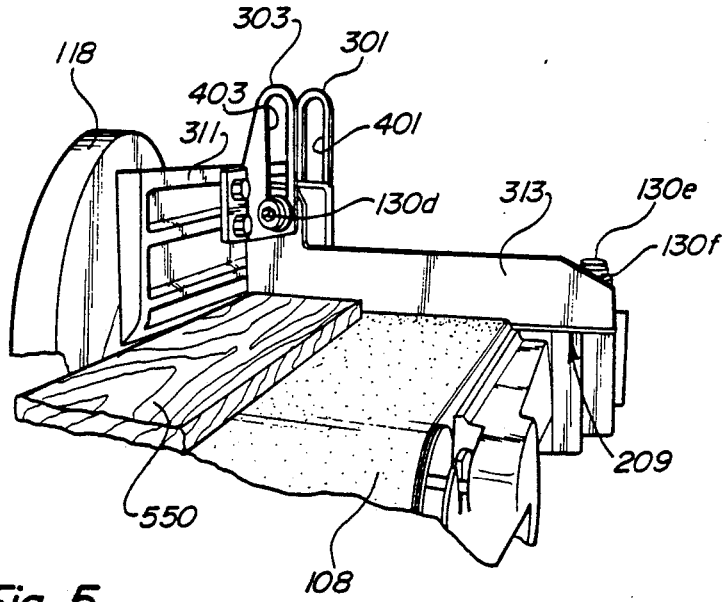
FIG. 5 is a perspective view showing the adjustable fence adjusted substantially at the extreme opposite side of the sanding belt such that the adjusting mechanism itself may serve as an end fence.

With the arrangement shown in FIG. 2, spacer member 209 serves to provide clearance between the bottom of fence member 305 and the abrading surface of sanding belt 108 whenever member 305 has been moved to a position overlying belt 108 (as, for example, shown in FIG. 5). Additionally, member 209, via edge surface 213 adjacent an edge of belt 108, functions as a stop for belt 108 which may tend to drift toward member 209 when belt 108 becomes loosened or misaligned with respect to the belt rollers.

The first fence member 311 also includes two slotted brackets 301 and 303 for receipt therethrough of adjusting bolts 130*b* and 130*d*, respectively, which are in turn received in tapped holes of support brackets 302 and 304, respectively, of the second fence member 305.

The second fence member 305 includes two longitudinally extending slots 307 and 309 adapted to receive therethrough the threaded shanks of adjusting bolts 130*e* and 130*f*, respectively, which in turn respectively engage the threaded mounting holes in portion 201 via spacer through-holes 203 and 205 (FIG. 2). Second member 305 additionally includes a raised wall portion 313 which, as will be seen from a discussion below, can be used itself as an end fence for the sanding belt 108.

Figure 4:
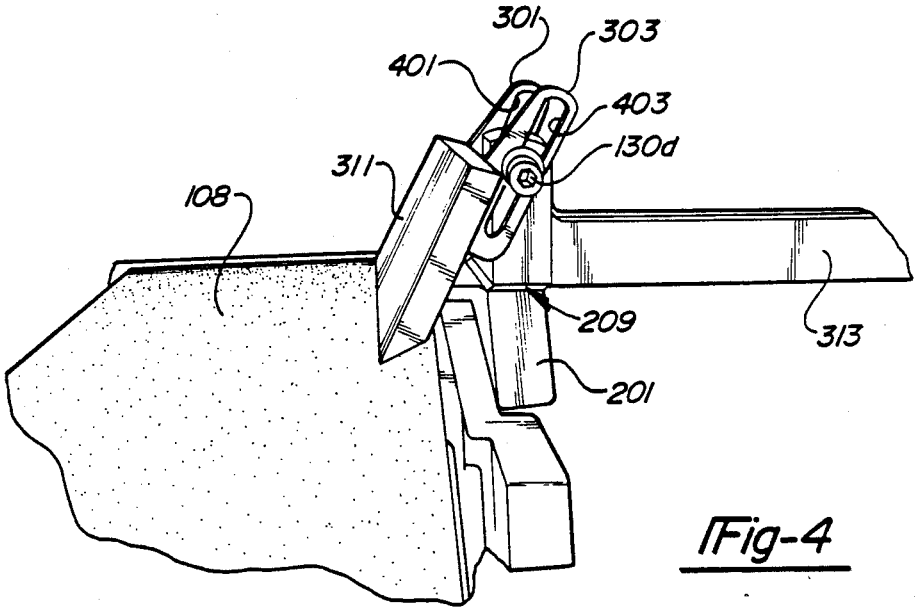
FIG. 4A is a perspective view showing the adjustable fence of FIG. 1 placed at a first angle to the plane of the belt sanding surface.
FIG. 4B is a view similar to that of FIG. 4A showing the adjustable fence at a second angle to the plane of the sanding belt.
Figure 4B:
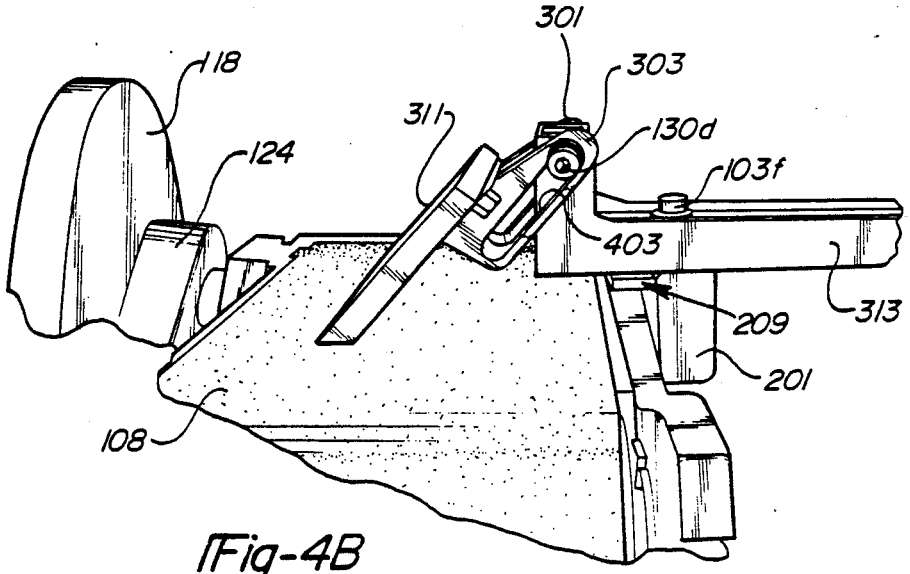

First member 311 of the adjustable fence assembly may be adjusted with respect to the angle it makes with the plane of the sanding belt by means of slotted brackets 301 and 303 with their respective adjusting slots 401 and 403 (See FIGS. 4A and 4B). Member 311 may be angularly adjusted by loosening adjusting bolts 130*b* and 130*d*, rotating member 311 to a desired angular orientation, and then sliding member 311 via slots 401 and 403 such that a desired clearance above belt 108 is attained. FIG. 4A shows an angular orientation of member 311 approximately midway through its adjustability range, while FIG. 4B depicts member 311 near the extreme of its adjustment range—i.e. making an angle of approximately 45 degrees with the plane of sanding belt 108.

Figure 3:
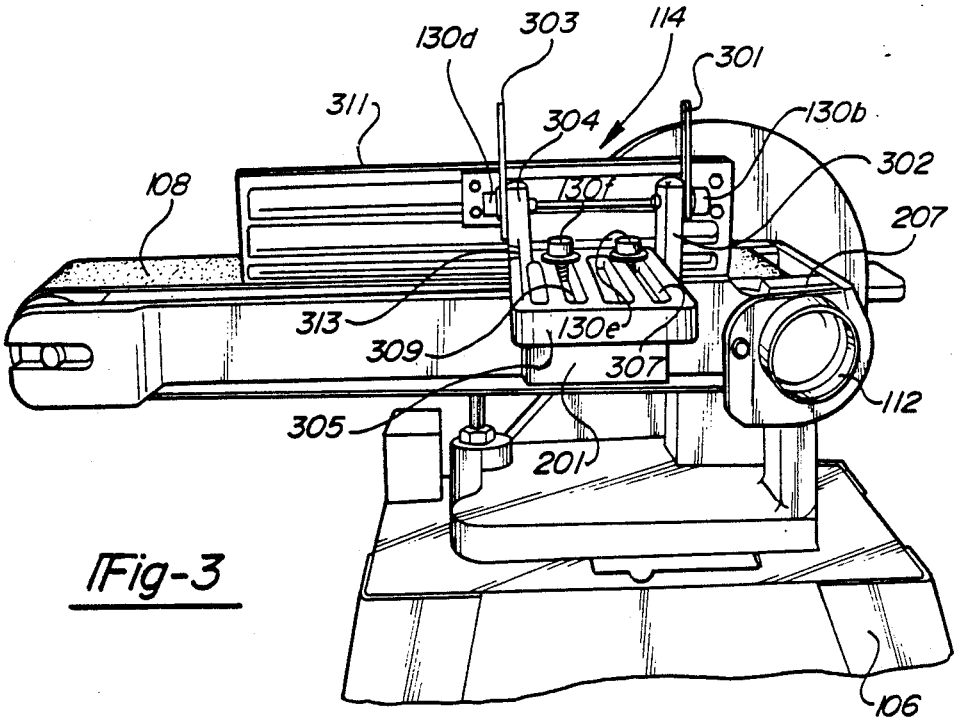
FIG. 3 is a perspective view of the belt sanding station of FIG. 1 taken from behind the adjustable edge fence mounted along the sanding belt.

With reference to FIGS. 3 and 5, it will be noted that the combined edge and end fence assembly 114 may be adjusted along the width of belt 108 in a direction substantially transverse to an axis of motion of the belt. Such adjustment is effected by loosening bolts 130*e* and 130*f* and sliding the second member 305 along adjusting slots 307 and 309 to the desired position relative to the belt 108. At that point, bolts 130*e* and 130*f* would be retightened. In FIG. 5, the fence assembly is shown in its extreme adjustment position relative to the width of sanding belt 108. In this position it will be seen that a work piece such as at 550 may be abutted against both the rear of member 311 and the wall portion 313 of member 305 which is now acting effectively as an end fence in the position shown in FIG. 5.

Figure 7:
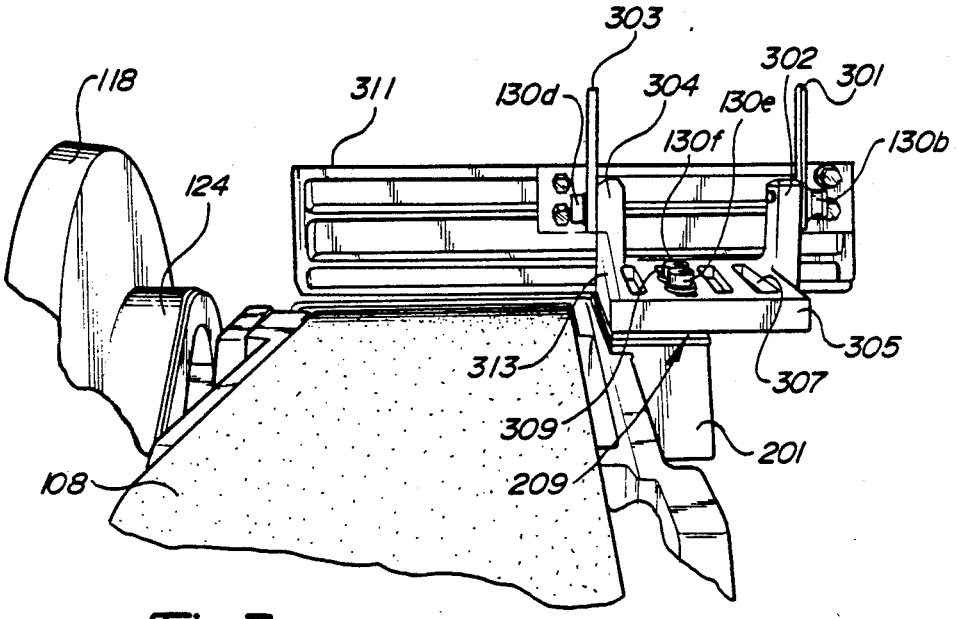
FIG. 7 is a perspective view showing the adjustable fence rotated 90 degrees from its position in FIG. 1 such that it may serve as an end fence continuously adjustable along a direction parallel to the axis of movement of the sanding belt.

Member 311 may also be used as an end fence by going through the adjustment steps best explained with reference to FIGS. 6 and 7. In FIG. 6, it will be seen that one of the adjusting bolts, in this case 130*e*, has been removed from its corresponding adjusting slot in member 305 and bolt 130*f* has been loosened thereby enabling the rotation of the fence assembly about bolt 130*f*. In FIG. 6 the assembly is shown in an intermediate position between the edge fence orientation shown for example in FIG. 3 and an end fence position or orientation shown in FIG. 7. To reach the orientation of FIG. 7, the operator rotates the fence assembly about bolt 130*f* such that its adjusting slot 309 will overlie both holes 203 and 205 (See FIG. 2). At this point, adjusting bolt 130*e* may be reinserted into its corresponding threaded hole but in this position both adjusting bolts will now lie in the same adjusting slot 309 as seen in FIG. 7. Upon the retightening of bolts 130*e* and 130*f* in this configuration, it will be seen that first fence member 311 is now usable as an end fence for the sanding belt 108. Additionally, with this arrangement, upon loosening bolts 130*e* and 130*f* it will be seen that the end fence 311 in FIG. 7 may be continuously adjustable in a direction parallel to the axis of movement of the belt by sliding member 305 along adjusting slot 309 to the desired position and then retightening bolts 130*e* and 130*f*. Indeed, it will be seen that with this novel arrangement, fence 311 may be oriented beyond the roller end of belt 108 to accommodate work pieces of longer length.

Adjusting Wrench Retainer Clip

Figure 8:
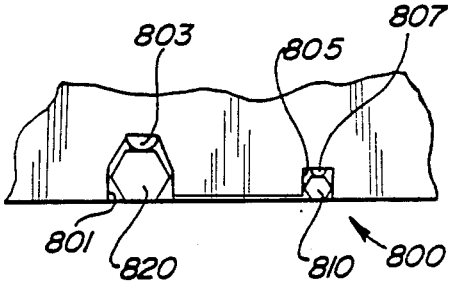
FIG. 8A is a partial cross-sectional view of a spring clip wrench retainer arranged in accordance with the principles of the invention.
FIG. 8B is a view taken from the bottom of the spring clip of FIG. 8A.

The invention additionally contemplates a retainer device for one or more adjusting wrenches such as hex wrenches for use in tightening and loosening the various adjusting bolts 130 described above. One such retainer apparatus arranged in accordance with the principles of the invention is set forth in FIGS. 8A and 8B. A spring clip 800 is fashioned of resilient spring-like material and includes channels such as at 801 and 805, each having spring biased wall portions and a bottom portion, the channels shaped for receipt of the shanks of adjusting wrenches 810 and 820. At the bottom surface of each channel 801 and 805 are raised dimple members for engaging the shaft along with the walls of the channel for retentive receipt of same. As seen from FIG. 8B, channel 801 includes dimples 803 and 803*a*, while channel 805 includes dimple members 807 and 807*a*.

Figure 8B:
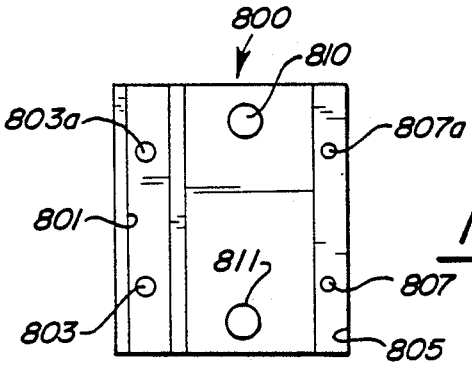

The spring clip 800 may be mounted to any preselected location on the support table 106 or on the support beds for the belt or disk sander assembly via suitably tapped holes mating with mounting holes 810 and 811 placed in the spring clip 800 at a position between the wrench receiving channels 801 and 805 (See FIG. 8B).

Sanding Station Support Table

Conventional support stands for stationary belt sander work stations have traditionally tended to be wobbly and prone to twisting when the support stand is pushed or otherwise moved. To overcome this prior deficiency in such stations, the present invention contemplates an arrangement for providing increased rigidity to the support stand.

Figure 9A:
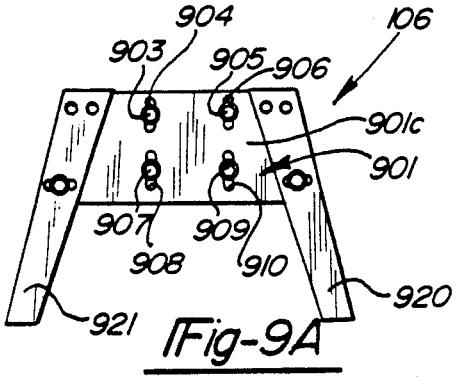
FIG. 9A is a side plan view of the support table arranged in accordance with the principles of the invention.
Figure 9B:
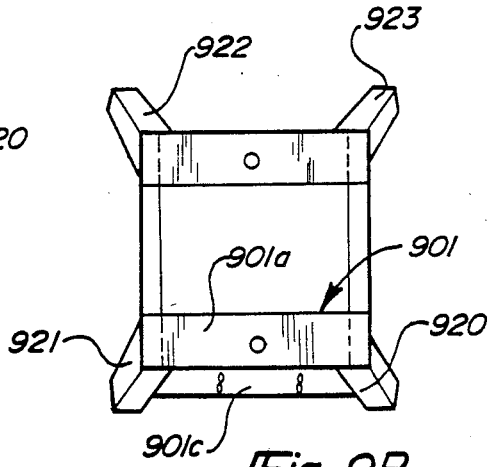
FIG. 9B is a top plan view of the support table of FIG. 9A.
Figure 9C:
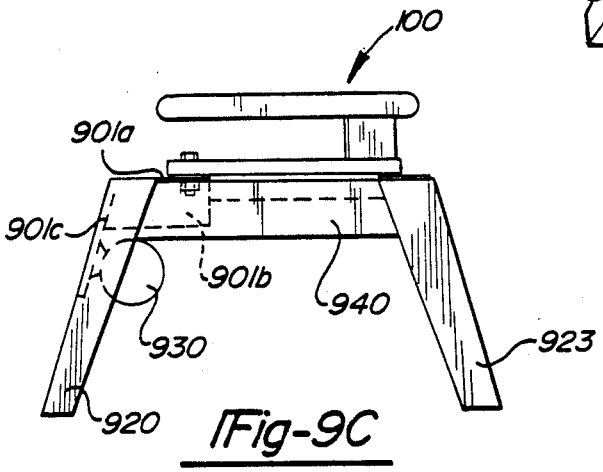
FIG. 9C is a side plan view of the table of FIG. 9A looking from the right side of the table as depicted in FIG. 9A.

The improved arrangement is best explained in conjunction with FIGS. 9A, 9B and 9C. In accordance with the invention, a motor mount panel associated with the support stand is made unitary with a portion of the mounting face for the sanding apparatus itself at the top of the table. As seen from FIGS. 9A through 9C, support stand 106 includes a plurality of legs 920, 921, 922 and 923 extending from a top surface toward the floor or surface upon which the support table is to stand. At one end of the table, a substantially L-shaped piece 901 has a top portion 901*a* and a side portion 901*c* extending downwardly from top portion 901*a* and including a plurality of mounting slots for mounting a drive motor 930 thereto. As seen from FIG. 9A typically four mounting slots 904, 906, 910 and 908 are positioned for receipt of mounting bolts 903, 905, 909 and 907, respectively. Unitary piece 901 also has flange portions such as 901*b* shown in FIG. 9C which serve as additional mounting points to the corresponding leg at the corner of the support table. As seen in FIG. 9A, additional leg mounting holes are provided at the opposite ends of motor mounting assembly 901 also for attachment to the two legs between which element 901*c* extends.

With the arrangement shown, the unitary element 901 serves both as a motor mount surface, a stand cross-frame member extending between legs 920 and 921 and as a mounting surface 901*a* at the top of the table for mounting one end of the sanding unit assembly 100 to the support table. For still further rigidity, support flanges such as at 940 additionally extend between the other three pairs of support table legs.

Belt Sander Dust Removal

Conventional sanding stations have typically come equipped with vacuum-based systems for removing dust and debris generated by the interaction of the sanding elements with work pieces. However, such arrangements have typically been inadequate for maintaining the work environment substantially free of such dust. This invention contemplates improving the dust removal arrangement for the belt sander assembly.

Figure 10:
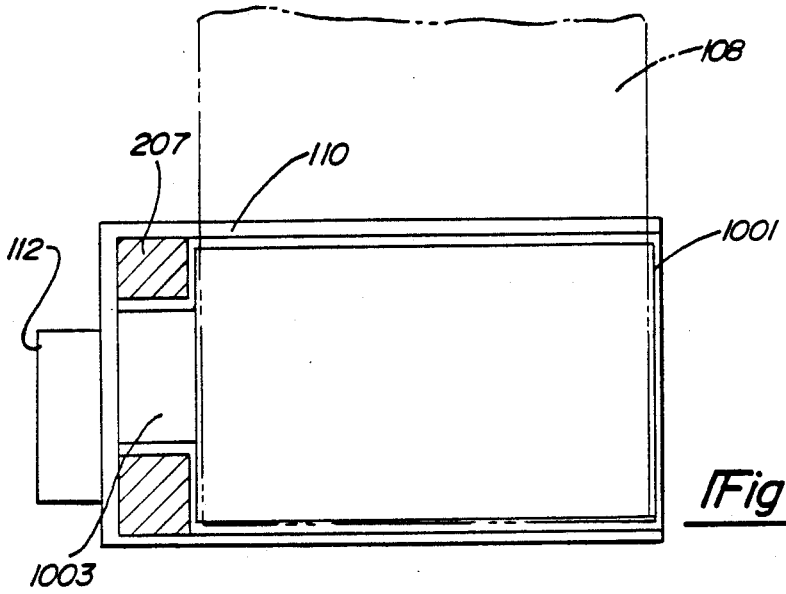
FIG. 10 is a partial cross-sectional view of a portion of the belt sander of FIG. 1 showing details of the dust collecter chamber and vacuum hose connection.

With reference to FIG. 10 in conjunction with FIGS. 1 through 3, it will be noted that at one end of belt pulley 1001, a drive shaft bearing carrier 1003 is typically placed concentric with the axis of the sanding belt roller. In conventional arrangements, the spaces adjacent the bearing carrier 1003 which lie substantially in the plane of the sanding belt 108 were left open thereby enabling air to be drawn therethrough towards the vacuum hose connection member 112. This in turn detracted from the capability of the system to effectively divert substantially all the saw dust and debris from across the sanding belt toward the source of the vacuum via dust collector 110. In accordance with the principles of this invention, such areas such as are shown at 207 have been closed off both at the top of the dust collector 110 as shown in FIG. 10 (and also in FIGS. 2 and 3) and at the bottom of the dust collector 110. With this arrangement, all open areas adjacent to and in the plane of the belt surface within the collecting chamber 110 have been closed off to substantially restrict air flow toward the vacuum source to the air flowing across the abrading surface of sanding belt 108.

Disk Sander Dust Removal

Figure 11:
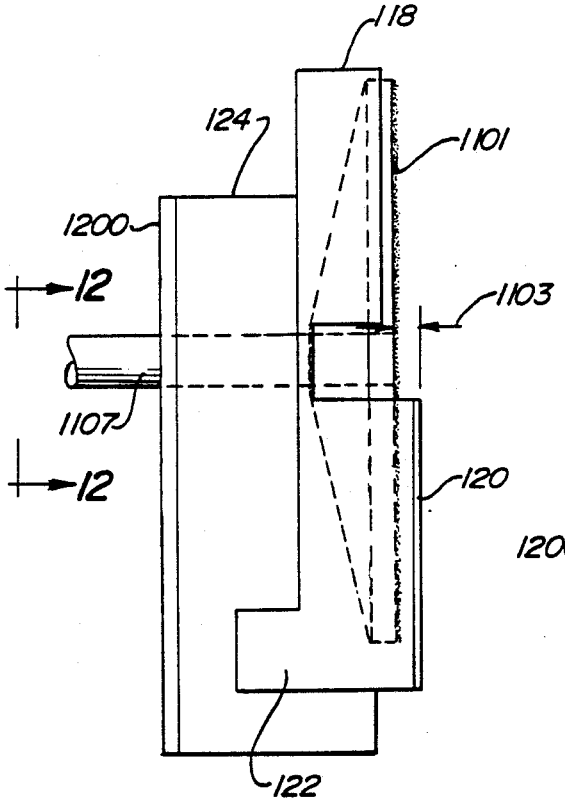
FIG. 11 is a side view of the details of the pulley and drive belt cover 124 and sanding disk guard 118 and its vacuum connection.
Figure 12:
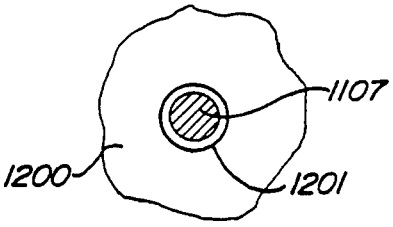
FIG. 12 is a partial view taken along lines 12—12 of FIG. 11.

As with the belt sander assembly, conventional sanding disks typically are provided in the same sanding station with the belt sander and also have suffered from problems of inadequacy in dust collection via vacuum systems. reference to FIGS. 1, 11 and 12, this invention overcomes certain problems in dust removal.

Conventional systems suffer from two principal problems which inhibit proper functioning of their vacuum dust collection arrangements. First, such systems have provided too much diametrical clearance where the drive shaft 1107 enters the drive belt and pulley cover 124. Reinforcing ribs 1105 on the back of the sanding disks in conventional units typically acted as fan blades and as a result drew more air into the vacuum area than the vacuum system could handle. Secondly, conventional sanding disk systems with dust removal arrangements provided a gap 1103 at the disk fan front guard cover which was too small to allow sufficient air to flow around the disk fan for dust particle removal. In accordance with this invention as seen from FIGS. 1, 11 and 12, these two problems have been alleviated. Clearance hole 1201 in rear wall 1200 of pulley and drive belt cover 124 has been substantially lessened in diameter over conventional systems such that a relatively close clearance fit is presented between the spindle shaft 1107 and the periphery of the clearance hole. Additionally, front face 120 of disk guard 118 has been found to offer most effective dust removal when spacing 1103 between front face 120 and sanding disk face 1101 is kept in the range of about one-quarter of an inch to about three-eighths of an inch. This spacing is on the order of two to four times the spacing used in conventional systems and has been found to promote better air flow around the disk fan for optimum dust particle removal. The clearance hole downsizing minimizes the adverse affects of disk support ribs 1105 acting as fan blades and disrupting optimum flow towards the source of vacuum.

The invention has been described with reference to details of a preferred embodiment. These details are given for the sake of example only, and the scope and spirit of the invention are to be determined in accordance with the appended claims.

What is claimed is:

1. In a stationary belt sanding work station having an endless sanding belt engaging spaced apart rollers mounted to a belt support bed, an improved adjustable combined edge and end fence assembly comprising:

a first sanding fence member, a second sanding fence member coupled to and extending transversely of the first member, the second member including means for effecting continuous adjustment of a position of the second member with respect to the belt support bed in a direction substantially parallel to an axis of movement of the sanding belt, wherein the means for effecting continuous adjustment comprises first and second longitudinal slots in the second fence member respectively overlying first and second fastener receiving holes in the belt support bed and first and second fasteners respectively extending through the first and second slots into the first and second fastener receiving holes, the fence assembly being adjustable along the first and second slots upon loosening of the first and second fasteners, and the fence assembly being rotationally adjustable upon loosening of one of the first and second fasteners and removal of the other one of the first and second fasteners from its correspondingly engaged slot.

2. The adjustable fence assembly of claim 1 wherein the first fence member is coupled to the second fence member by means for continuously adjusting an angle of the first face member with respect to a plane of the belt sanding surface.

* * * * *